US005666671A

United States Patent [19]

Daneshvar

[11] Patent Number: 5,666,671

[45] Date of Patent: Sep. 16, 1997

[54] FACIAL MASK

[76] Inventor: Yousef Daneshvar, 21459 Woodfarm, Northville, Mich. 48167

[21] Appl. No.: 350,473

[22] Filed: Dec. 7, 1994

[51] Int. Cl.[6] ..... A41D 13/00

[52] U.S. Cl. ..... 2/424; 2/9

[58] Field of Search ..... 2/9, 424, 15, 428, 2/DIG. 3, 173, 427, 202, 195.1, 11, 12, 413, 206, 422, 410; 128/201.15, 201.23, 201.24

[56] References Cited

U.S. PATENT DOCUMENTS

| | | | |
|---|---|---|---|
| 1,017,049 | 2/1912 | Greenwood | 2/173 |
| 1,947,786 | 2/1934 | Lueck et al. | 2/173 |
| 2,036,850 | 4/1936 | Bullard | 2/9 |
| 2,344,920 | 3/1944 | Maggi | 2/9 |
| 2,631,287 | 3/1953 | Malcolm, Jr. | 2/9 |
| 2,665,686 | 1/1954 | Wood et al. | 2/9 |
| 3,241,155 | 3/1966 | Phillips | 2/9 |
| 4,069,516 | 1/1978 | Watkins, Jr. | 2/428 |
| 4,250,577 | 2/1981 | Smith | 2/9 |
| 4,259,748 | 4/1981 | Miller | 2/9 |
| 4,524,465 | 6/1985 | Huber | 2/428 |
| 4,734,940 | 4/1988 | Galet et al. | 2/422 |
| 4,817,633 | 4/1989 | McStravick et al. | 2/428 |
| 4,850,049 | 7/1989 | Landis et al. | 2/9 |
| 4,920,576 | 5/1990 | Landis | 2/9 |
| 4,965,887 | 10/1990 | Paoluccio et al. | 2/9 |
| 5,014,366 | 5/1991 | Discipio, Sr. | 2/DIG. 3 |
| 5,093,937 | 3/1992 | Kamata | 2/424 |
| 5,099,114 | 3/1992 | Salce et al. | 2/9 |
| 5,099,525 | 3/1992 | Millauro | 2/9 |
| 5,148,550 | 9/1992 | Hodgkinson et al. | 2/9 |
| 5,410,757 | 5/1995 | Vienamo et al. | 2/9 |
| 5,431,156 | 7/1995 | Sundstrom | 2/9 |
| 5,438,710 | 8/1995 | McDonald et al. | 2/9 |
| 5,446,925 | 9/1995 | Baker et al. | 2/9 |

*Primary Examiner*—Amy B. Vanatta

[57] ABSTRACT

A facial mask having a frontal body portion for frontally fully covering a face including forehead, chin, right cheek, and left cheek. The frontal body portion has a transparent zone for allowing a user to see out. The mask body also has further body portions that extend posteriorly from the frontal body portion over a frontal portion of a scalp and along sides of a face below the scalp, and that have a posterior edge which lies forwardly of the ears. A brim member is separably mounted on at least one of these further body portions. A vapor barrier member extends laterally across the inner side of the frontal body portion for passing across the cheeks under the eyes and across the bridge of the nose to seal off the breathing area from the eye area.

21 Claims, 5 Drawing Sheets

FACIAL MASK

REFERENCE TO RELATED APPLICATIONS

Figure 1:
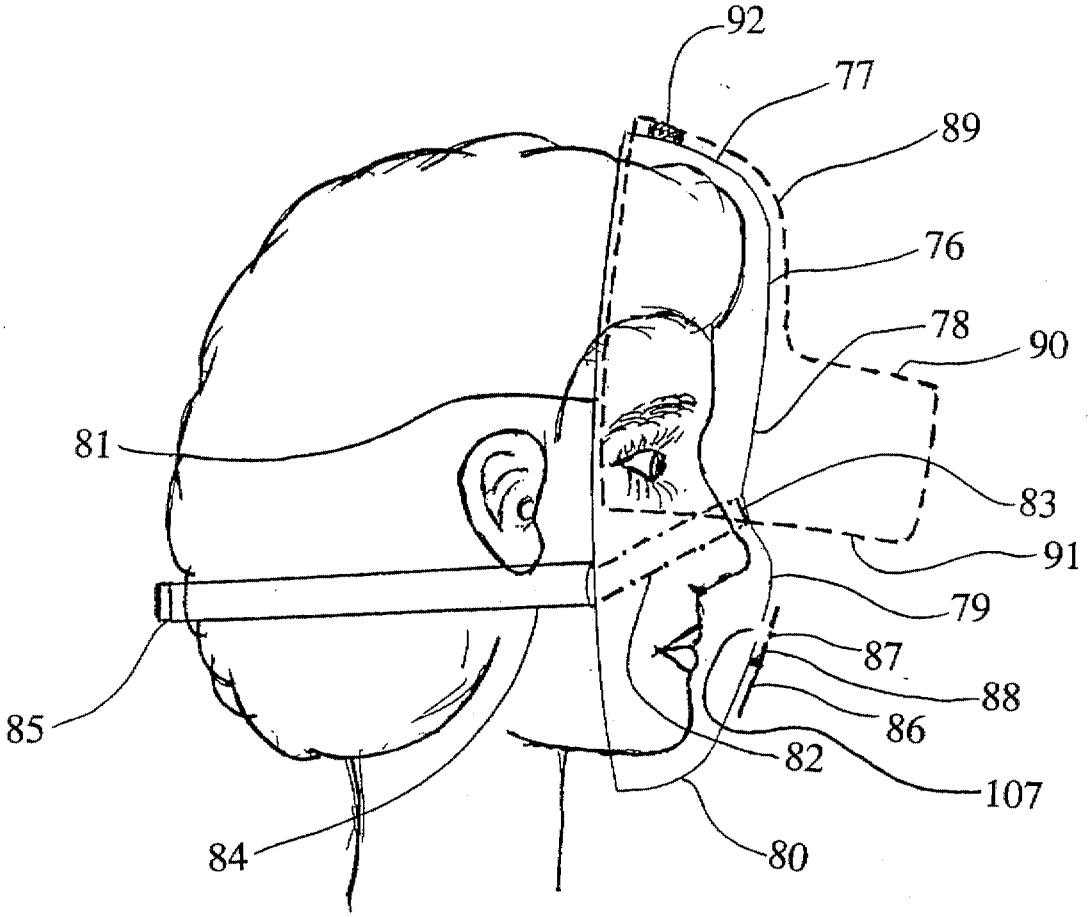

Reference is made to Super Masks, Ser. No. 08/179,329, filed Jan. 10, 1994 and Super Hats, Ser. No. 08/340,659, filed Nov. 16, 1994, the contents of which are incorporated herein by reference as if fully disclosed herein.

BACKGROUND OF THE INVENTION

Harsh cold weather causes significant problems in human beings, especially when combined with wind. The worst circumstances occur when the cold, wind and rain or snow combine. This combination will cause almost every one to suffer and keep many jobs from being done. The effect of these conditions is mostly seen in the uncovered areas of the body, such as the face, but also in areas such as the eyes, nose and bronchial system. Conditions such as Rhinitis, sinusitis, and many heart and lung diseases will worsen after exposure to severe conditions. Unfortunately, most of the available winter clothes are not designed to protect important areas such as the face properly. Commonly, the heavy coats have a thick hat that covers the head, the ear and the sides of the face but not the more sensitive areas such as the eyes and the nose. This causes a lot of discomfort, suffering and many health problems. In fact, this applicant has first hand experience with harsh weather, since he was raised in the cold environment of Zanjan, Iran and later has been living in the suburbs of Detroit, Mich. Going to his daily walks in the winter time at night, he has felt many of the problems associated with cold. Gradually he has build up a belief that harsh weather should be avoided, and that exposure to cold should be prevented in order to prevent many medical problems which are caused by it. This will be not only more likeable but also more economical, since one episode of sinusitis or a severe case of bronchitis is enough to disable a person for many days, not mentioning the worse complication that occurs from time to time. For these reasons, and in order to prevent "human suffering" this applicant previously introduced units such as "Super Masks" and "Super Hats". This new invention is meant to be a relatively simpler unit that can be easily used by many people. This unit can simply be put on the face and held in place by one or more bands or straps, and will prevent the direct contact of the cold air, moisture and the wind chill factors, which are able to cause significant health problems in a short time.

THE BRIEF EXPLANATION OF THE INVENTION

These masks will be made from a clear polymer that is shaped to stand in front of the face and also to curve in the sides in order to prevent the unwanted air from reaching the sides of the face. Importantly this mask will have a barrier made of sponge in order to prevent air motion between the nose-mouth area and the eyes. This is to prevent the creation of fog in the eye area. This unit may have a closed front, or alternatively the unit may have a door that will allow the amount of incoming air to be adjusted. Furthermore, this unit will have a brim to prevent rain and snow from reaching the eye area. The unit will be held in place by one or more bands or straps.

THE BRIEF EXPLANATIONS OF THE FIGURES

FIG. 1. Shows the side view of a person who is wearing a super mask.

Figure 2:
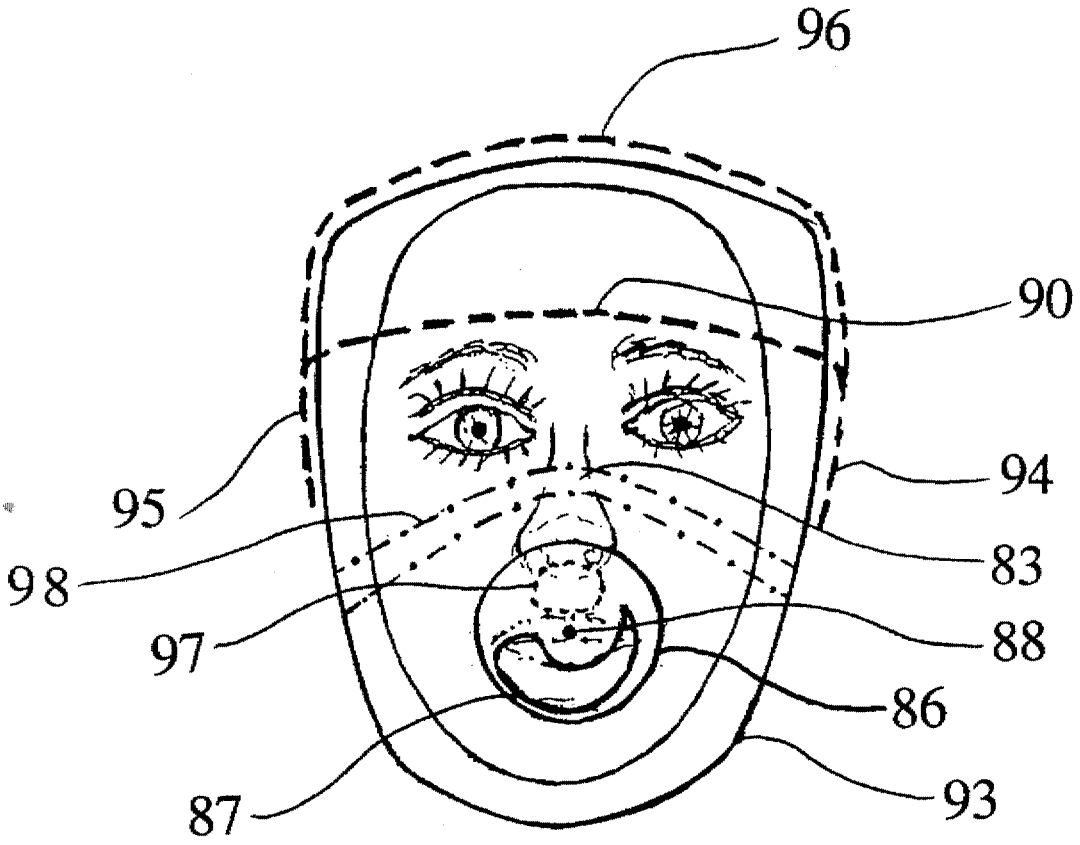

FIG. 2. Shows the from view of a person who is wearing a super mask.

Figure 2A:
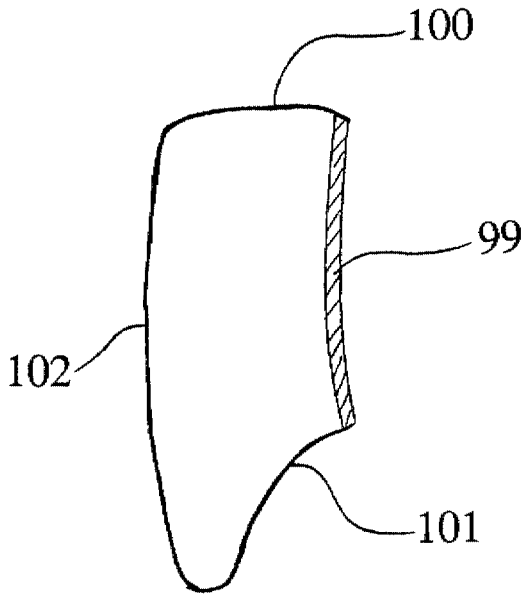

FIG. 2A. Shows a cover piece that can be optionally connected to the super mask.

Figure 2B:
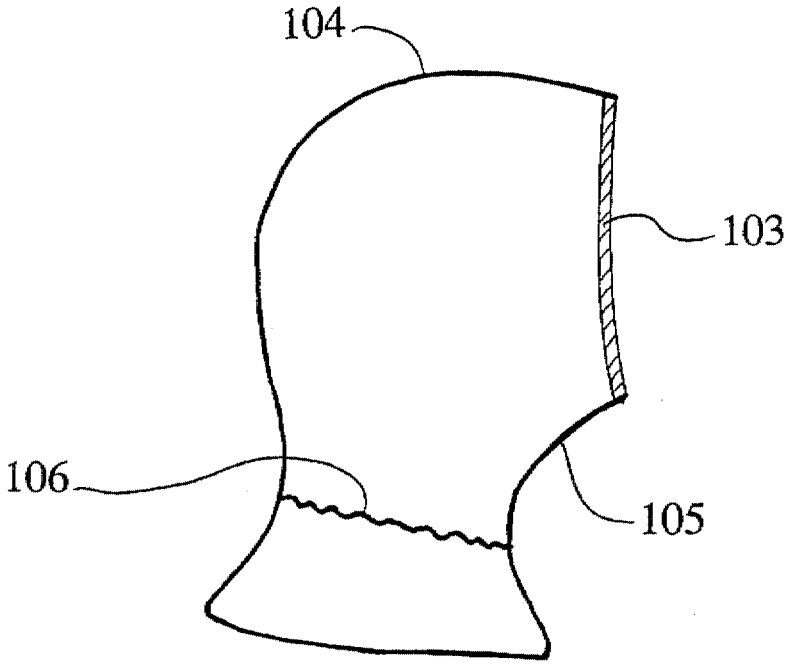

FIG. 2B. Shows a larger cover piece for optional use with a super mask.

Figure 3:
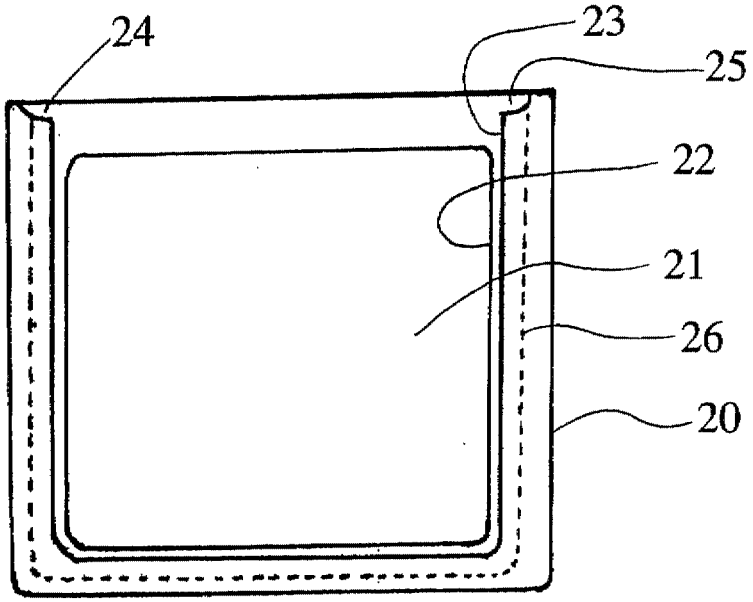

FIG. 3. Shows a plastic frame with a slot which is to stand in from of the nose-mouth area of a super mask.

Figure 4:
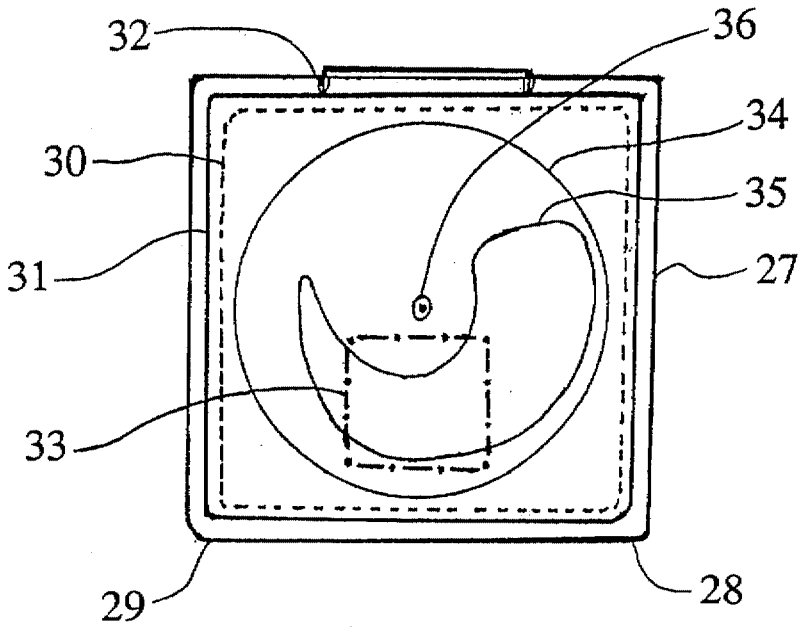

FIG. 4. Shows a window unit that is to allow the nature and amount of the incoming air to the mouth area to be controlled.

Figure 5:
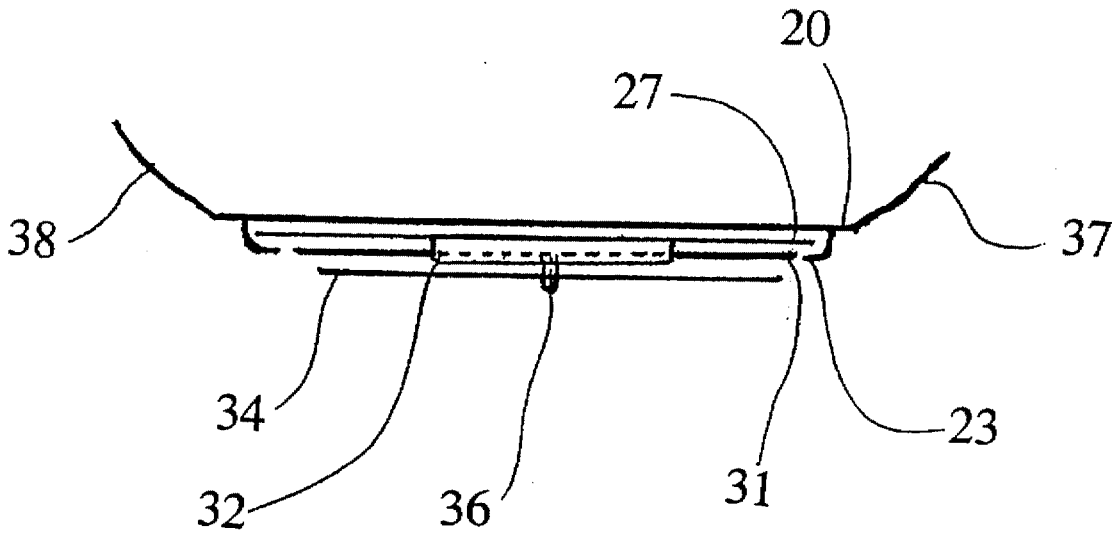

FIG. 5. Shows the cross-cut view of the window unit when it is placed inside the body of the frame, shown in FIG. 3.

Figure 6:
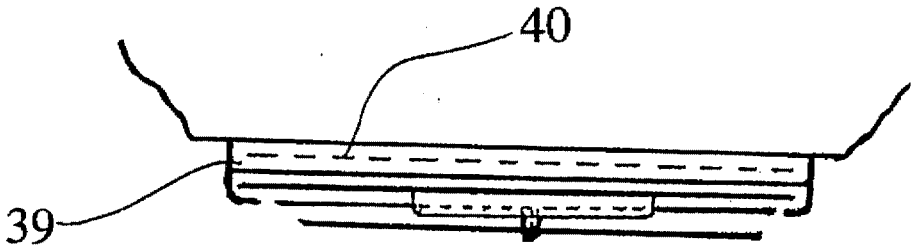

FIG. 6. Shows a unit similar to the one shown in the previous FIG. 5, except it has an extra slot 39.

THE DETAILED EXPLANATIONS OF THE FIGURES

FIG. 1. This figure schematically shows the side view of a person who is wearing a super mask. In this figure the body of the unit is shown at 81 and will be made from a layer of clear polymer which may be rigid, semi-rigid or soft or of their combinations. This unit will have curved sides (such as 77 & 80) that will go around the face in order to prevent the wind from reaching the face. The front body of this unit 76 will stand in front of the frontal area and the upper part of this unit 77 will stand in front of the forehead. The unit will have a part 78 which will stand in front of the eyes and provide a clear vision. This part may extend in some models in order to allow a pair of eyeglasses to stand in the area comfortably. The area 79 will expand to have a proper shape in order to accommodate the nose inside safely. The sides of this unit will also curve toward the sides of the face. The lower part 80 will curve around the chin and will protect it. This unit will have a padding, a seal or a band 82 which will stand on the base and sides of the nose in order to function as a barrier or seal and prevent the exhaled air or incoming air from reaching the eye area. The center point of this padding is marked at 83. Importantly, this piece will be connected to the body of this unit by a detachable method, so that it will allow this unit to be switched, washed or exchanged. This mechanism will allow differently sized pieces to be used with the unit. This barrier may be made from sponge, rubber, inflated "bubbles" or inflatable balloons, or a similar material that will be non-irritant and comfortable. This piece may have some metal wires, bands or similar units which will allow it to accept a contour and hold a given shape. The elastic controllable strap 84–85 will allow the unit to be held in place secure and comfortably. Importantly in some models the unit may have more than one strap; for example, a second strap may be placed in the front area or so to hold the unit more securely. In some models the front of this unit may have holes such as the ones shown in 107 in the nose-mouth area. This is to prevent feelings of suffocation and allow more air to move in for breathing. This unit may have a control system in order to allow the amount of incoming air to be adjusted. Such a control will be done by the use of a round piece 86, which is connected to the body of the unit by the pole 88. The round piece 86 has a variable opening 87 (best seen in the front view shown at FIG. 2). The rotation of the piece 86 will allow the amount of incoming air to be adjusted. This unit may also have a brim 90, which has the body 89 that will be removably connected to the base of this unit at 92. The connection spot may be wider and longer, and there may be more than one used. This mechanism will allow the brim to be used optionally. The brim piece 89–90 will have side walls as well (one marked at 91) which will prevent participation such as rain, snow, etc from entering the vision area.

The size, shape, thickness, consistency, relative size and thickness, coloring and every other important factor and characteristic of the brim piece may vary in different units. Importantly, these units may have an opaque part in the lower area under the seal for the nose (or the surface of the area here may be painted opaque) to prevent small expelled particles from being seen. Also, the inner wall of this unit may have a layer of absorbent material in order to absorb and hold such small particles.

Importantly, this unit may use patches or pads made of sponge, "plastic bubbles", balloons or any other comfortable padding that can be removably attached to the inner surface of this unit at different areas such as the frontal area, chin area or the sides. This is to prevent the body of the unit from touching the skin of the face and allowing the air to move in.

FIG. 2. This figure schematically shows the front view of a person who is wearing a super mask. In this figure the body of the unit in the lower face-chin area is shown at 93. The center of the barrier piece is marked at 83 and the body of the barrier piece in the right side is marked at 98. This Figure also shows the center of the brim 90. The brim has a body that is removably connected to the base of this unit at area 96 by the connection means of 92. This connection means will be reversible and can be of any kind: snaps, screws, Velcro (™) patches, etc. It may be wider, longer or placed in the other parts of this unit as well. The brim system shown in this figure and the previous FIG. 1 also has the side walls 94 & 95 which are designed to prevent rain or snow from moving in toward the vision area.

The opening 97 is in the nose-mouth area and is designed to allow the air to move in and prevent feelings of suffocation. This opening has the control system made by the use of the round piece 86, which is connected in its center to the body of the trait by the pole 88. This round piece has a variable opening 87 which will allow the amount of incoming air into the unit to be adjusted, depending on which part of its opening 87 faces the opening 97 of the body of the main unit.

FIG. 2A. This figure schematically shows the side view of a cover piece that can be optionally connected to the body of the unit, shown in the previous FIGS. 1 & 2 in order to further protect the sides of the face from the incoming cold or wet air. In this Figure the front border of this unit that will be connected to the rear border of the mask 81 is marked at 99 and the upper part of it at 100. The lower part of this cover is marked at 101 and the rear rim at 102. This piece will be made from a stretchable non-permeable material that will be a likeable non-irritant material.

FIG. 2B. This figure shows the side view of a cover piece that is similar to the one shown in the previous FIG. 2A except this unit is larger in order to cover the whole head, the neck and possibly the upper chest area. In this Figure the front border of this unit is marked at 103 and the upper part of it at 104. The part for the upper-neck lower-chin area is at 105 and the elastic piece that will hold this piece close to the neck area is at 106.

Importantly, when the unit is closed, the unit may have one or more exhaust systems similar to the one shown in the previous Super Hats unit (marked at 9) which may be placed in a proper area such as the sides of the face in order to allow the exhaled air to be expelled out without going to other areas and causing problems. The exhaust system may have an adjustable opening or a flap, cover or door in order to control air motion through the exhaust. This flap consists of two pieces of round plastic with openings. These pieces will be connected to each other by a pole in their center, so that the outer plastic can be rotated in order to allow the openings to match each other or oppose each other. This will allow the amount of the incoming air to be controlled. The edge of the outer plastic may be curved to cover the inner unit in order to prevent snow from going inside it.

FIG. 3. This figure shows a plastic frame with a slot which is to stand in front of the mouth and allow a desired piece to be inserted into the slot for use. In this Figure the body of this piece is shown at 20; it has a wall 23 that creates the slot for the insertion of the other piece. This unit will have an opening in the center which is marked at 21 and will stand in front of the mouth and nose. The border of this opening is shown at 22. No 26 shows the outer border of the slot. Numbers 24 and 25 show the entrance of the slot for the incoming piece. Importantly, this frame may have an opening for the attachment of an oxygen tubing which would allow oxygen users to go outdoors comfortably. Such an opening will allow treated air to be pumped inside the unit as well.

FIG. 4. This figure shows a window unit that is to allow the nature and mount of the incoming air to the mouth area to be controlled. This will be made from a plastic frame shown at 27 which is properly-sized to fit into the slot of the unit shown at FIG. 3. This will be done by holding the spots 29 and 28 in front of the spots 24 and 25 (of the unit shown in FIG. 3) and pushing the unit inside the slot (shown in the previous figure) which will close the opening 21. The frame 27 has an opening inside, whose border is marked with a dotted line at 30. This opening will be closed by the door 31 which is hinged to the frame 27 at the point 32. The door 31 has an opening marked with a dot-and-dash line at 33. This opening will allow the air to pass into the mouth and nose area. The door 31 has a circular piece 34 in its front which will rotate around the pole 36. The piece 34 has the opening 35 in it, that with rotation, will allow the amount of incoming air to the nose and mouth area to be controlled or closed. Importantly, the door 31 can be opened to allow the whole opening 30 to be open for different reasons such as eating or drinking, etc. Please notice that the hinge 32 may be placed in another site.

FIG. 5. This figure shows the cross-cut view of the window unit shown at FIG. 4 when it is placed inside the body of the frame shown in FIG. 3. In this Figure the base of the frame is marked at 20 and is mounted to the mask of the main unit marked in the right at 37 and in the left at 38. The frame 20 has a short wall 23 which forms a slot, and this slot accepts and holds the window unit. The frame of the window unit is marked at 27 and holds the door 31 by the hinge 32. The door can open and close due to the function of this hinge. The door 31 has the rotary, circular piece 34 mounted to its center by the pole 36 so that this circular piece can rotate along this pole. The rotation of this piece 34 will allow the amount of incoming air into the mouth to be controlled.

FIG. 6. This figure shows the cross-cut view of a unit similar to the one shown in the previous FIG. 5, except this figure also has an extra slot 39 which allows a filter 40 to be inserted inside the slot in order to allow the nature of the incoming air to be changed.

THE DETAILED EXPLANATION OF THIS INVENTION

Exposure to the cold and cold wind not only is uncomfortable but also is a health hazard. The exposure to cold wind and moisture is even worse and mostly affects the uncovered areas of the body such as the face and its sensitive areas: the eyes, the nose and even the bronchial system. The applicant believes that such an exposure may cause or exacerbate conditions such a Rhinitis, sinusitis, and certain kinds of heart and lung diseases. Unfortunately, most winter clothes are not designed to protect such important areas. Commonly, the heavy coats have a thick hat that covers the head, the ears and the sides of the face but not the sensitive areas such as the eyes, nose, and therefore they can not prevent from the discomfort, suffering and many other health problems that occur due to the exposure of the face of the person with the winter conditions and critical wind chill factors. Being raised in a cold environment such as Zanjan, Iran, and later living in the suburbs of Detroit, Mich., the applicant has experienced first hand the hazards due to extreme weather while going for daily walks in the winter time at night. To some degree he was raised with the belief that facing and tolerating such difficult conditions was part of manhood and raising to be a man. From the other side, even proper protective units were not available at that time and strangely they are not even available now. As a doctor, this applicant now believes that the prevention of medical problems which occur due to the exposure to the harsh weather is wise and needed and should be done as much as possible. It is better and more economical to prevent such problems and people should have better options to protect themselves from such problems. For these reasons, and in order to prevent from "human suffering," this applicant has previously introduced units such as "Super Masks" and "Super Hats". This new invention is meant to be a relatively simplified unit that can be used easily by many people. This unit can be simply put on the face and held in place by one or more bands and straps in order to prevent the direct contact of the face with the cold, moist, windy unwanted air and to avoid the health problems that they may cause in short time. These units will even prevent from direct contact with other hazardous particles such as allergens, etc. This can be very beneficial.

These units will be made from combinations of the following pieces:

A. Basically, this mask will be made from a clear polymer that is shaped to stand in front of the face and is curved to cover the sides of the face in order to protect them as well. The unit will be shaped to match the shape of the face in order to be comfortable; it will have a proper space for the nose and will allow the cheeks, the forehead and the chin all to be positioned comfortably inside this unit without touching its body. In fact, pieces of padding made from sponge, "plastic bubbles", inflatable or precharged balloons or similar materials may also be used to prevent such contact. These paddings will be connected to the body of unit removably in order to allow them to be removed or exchanged if so desired. These pieces may be placed in points such as the forehead, the chin or the sides of the face etc., in order to prevent from direct contact. This unit also will be made to have an expanded eye area in order to allow them to be used by people who wear eyeglasses. This unit will be held in place by the use of one or more adjustable elastic bands or straps, which will be connected to the sides of this unit.

Importantly, this mask will have a piece of padding made from sponge, "plastic bubbles", inflatable or precharged balloons, similar materials or their combinations in order to occupy the space between the nose and sides of the face and the inner surface of this unit. This piece will be removably attached to the body of this unit in order to allow this piece to be changed for different reasons. The purpose is to make a seal to prevent air movement between the nose-mouth area and the eyes. This is in order to prevent the exhaled most air from entering the eye area and creating fog. This padding may have a piece of metal, plastic (or similar material) or a mechanism in order to allow the shape of this piece to be adjusted to match the shape of the nose of the user. Importantly a piece or flap of a thin layer made from a material such as vinyl may also be used to perform such a function. Such a flap will be made to expand and stand like a wall in front of the moving air and prevent the air from passing. The size, shape, consistency, materials, coloring and other characteristics of this piece may vary. In some models, this sealing unit will be made to surround the nose-mouth area. This will mainly be done in cases that the unit will have other covers as well in order to make it more like a closed unit. Importantly, these units may have an opaque part in the lower area under the seal for the nose (or the surface of the area here may be colored opaque) to prevent small expelled particles from being seen by an observer. Also the inner wall of this unit may have a layer of absorbent material in order to absorb and hold such small particles. This piece may be exchangeable in units which are durable.

B. Although the front wall of this unit will be closed, in some models this unit may have one or more holes in the nose-mouth area in order to allow the air to move in. Such a unit may be further fortified by a mechanism that will allow the amount of the incoming air to be controlled. A model of this was shown in the previous application of Super Hats and is shown here in FIG. 1 at 86–88. This method will consist of a single opening in the nose-mouth area of the unit shown at no 97 FIG. 2, as well as a rotary round piece no 86, FIG. 2 that is connected to the front of the unit by the pole 88. The piece 86 has the opening 87 that has a special shape so that it will allow the amount of incoming air to be changed with rotation.

C. The method of air control which was mentioned above may also use the same system which was shown in previous applications of "Super Hats." Such a system was shown in FIGS. 3–6 of that application. These methods allow the person to have the option of closing the front wall and opening it like a small door connected by a hinge or allowing the air to move inside in a controlled fashion. This design also allows the use of a filter as well. In this method the front of the unit will have an opening similar to the one shown at no 21, FIG. 3. This piece will have the frame 20 and the sliding ports of 24 and 25. The piece that will fit this unit is shown at FIG. 4. This unit has a door 30 and a matching round piece 34 which will rotate along the pole 36. This will allow the openings 33 & 35 to be opposed to control the amount of the air that goes through this system. The comers 28 & 29 of this frame 27 will slide into the opening 24 & 25 from the FIG. 3. More details of these units are mentioned in the explanation of these figures. The side views of these units are shown at FIGS. 5 and 6.

D. In some models, the body of this unit in the eye area will be shaped to allow the use of eyeglasses to be done comfortably.

E. This unit may also have a brim that will prevent snow and rain particles from reaching the eye area. Importantly the brim of this unit may also have side walls that will curve to cover the sides of this unit and prevent precipitation from entering the eye area.

F. Importantly, the brim of this unit may connect to the body of this unit on a detachable basis so that the person will have the option of using them on a desired basis. This will be done by attaching the brim to the body of this unit by a reversible means such as snaps, Velcro (™) patches, etc. One example of this unit is shown in FIG. 1 at 89–92 and in FIG. 2 at 90, 92 and 94–96.

G. Importantly, the brim may be connected to the body of this unit by a hinge means so that it will allow the brim to be moved away when desired.

H. Importantly, these units may have an opaque part in the lower area under the seal for the nose to prevent small expelled particles from being seen. Also, the inner wall of this unit may have a layer of absorbent material in order to absorb and hold such small particles.

I. This unit also may have a detachable cover that will be attached to its sides in order to go over the head and sides of the face in order to prevent cold air, rain or snow from reaching it. This cover will be made from a suitable soft fabric which may have a non-permeable outer surface to prevent moisture from moving in. This piece will be connected to the side of this unit by a reversible means such as snaps, Velcro (™), elastic bands or their combinations, etc. An example of these pieces are shown at FIGS. 2A & 2B.

J. The detachable cover may be made to cover only the face and the neck area as shown in FIG. 2A or it may be made to go over the head and neck as well, as shown in FIG. 2B. In some models it may cover the front of the chest as well. The unit may be even be part of a bigger unit such as a poncho.

K. In some cases, the mask may close the exhaled air passage. Then the unit may have an opening in the sides of the attaching cover or a system such as the exhaust system which was explained in the applications of "Super Masks" and "Super Hats" which would allow the exhaled air to move out. The exhaust system may have a cover or controllable opening that will allow the size of opening of exhaust to be changed.

M. The front body of this unit may be made from soft, semi-rigid or hard polymers or their combinations. Importantly it may be made from the combination of an inner layer from a soft vinyl and an outer layer made from a rigid clear polymer, that are stuck to each other. This will prevent the unit from causing injury if the outer layer broke, since the inner layer will be thick enough to prevent sharp pieces of the broken outer layer from injuring.

N. Importantly, the body of this unit may be made from a soft clear polymer which will be held in place by a skeleton or a frame that will allow the soft unit to hold its shape and contour as designed. In some cases, this method will allow the unit to be shaped as desired to meet the facial body of the user.

O. Importantly, the padding of these units for the nose area may be made from a precharged or an inflatable balloon which will be properly shaped to fit the base of the nose and fill the sides of the face as well. This balloon may be covered by a soft fabric in order to prevent irritation of the skin. The sponges also may be covered by a soft likable fabric in order to prevent local irritation.

P. "Plastic bubbles" may be used in making such a padding to prevent air motion or contact with the skin of the person. These bubbles may be covered by a soft likable fabric in order to prevent local irritation.

Q. Also combinations of sponge, balloon, plastic bubbles or soft materials may be made in order to make more comfortable proper paddings for this purpose.

R. The unit may also have a tube connection opening piece similar to the one shown in previous unit of "Super Hats" in order to allow a tubing to be connected to it. This tubing is to allow oxygen or another treated gas to be pumped in.

S. Like the units mentioned in the previous application of "Super Hats," these units may also have other pieces such as microphones and speakers connected to them in order to allow communication in difficult circumstances to be facilitated.

T. The coloring of different areas of this unit may vary in different units.

The uses of these units are many and the applicant believes that this unit will allow many jobs to be done easily in difficult conditions. The unit may be used in the Army, on ships, or in severe conditions such as in the Arctic region, etc. This unit will importantly protect the nose, mouth and respiratory systems and may prevent many cases of sinusitis, bronchitis, anginal pain and suffering in the susceptible cases to prevent human suffering. It is important to recognize that many times the prevention of a problem is far more easier and economical than the cure. For example, if this unit could prevent one case of bronchitis, it will pay for its expense a couple of times over. This unit will be very valuable if a person could use it to continue his/her walks and promote their health. The applicant is quite interested to see what the use of such a unit will bring if it was used by school children in cold weather (while they wait for school buses) such as Michigan winter. The applicant wants to see if this could diminish the rate of respiratory problems at a noticeable rate.

One use of these units will be in the medical field. In this case, a basic unit which has a face mask, the sealing piece and the band will be used in order to prevent the user from being contaminated by any antigens or diseased particles from the sick patient. Also, this unit will prevent contaminated materials from the nose or mouth of the operator to reach the patient as well. The curved walls of this unit provide the further protection that is needed for such a unit; they will prevent the contamination of the field by the small particles that will be expelled during the sneezing or coughing from the operator. Importantly, the lower area of these units (under the seal for the nose) may be made opaque in order to prevent accidentally expelled particles from being seen by an observer. Also, the inner wall of this unit may have a layer of absorbent material in order to catch, absorb and hold such small particles.

Importantly, when these units have an exhaust system, they may also use one-way valves to direct the air only in one direction. This will prevent the air from entering through the exhaust system.

The units that are to treat the air were explained in the previous application of "Super Masks". Basically these units will consist of a body with filters that will purify the air and have a source of heat to warm it. The air may also be altered by adding humidity or taking the extra moisture away from it. Ionizers may be added in some cases as well. Perfumes or medications such as Broncho-dilators may be added to these units. The air from such a source will be carried inside the Super Hats by a canula and will allow the person to enjoy it. A fan will help move the air and may also be used to suction the air from the exhaust system.

Importantly, the teaching in this application may also be used in making the face masks as well. For example, the use of removable front doors with spaces for the filter will be a very comfortable means of controlling the incoming air in units that were introduced in the application of Super Masks. Therefore the applicant indicates such models and indicates that it will be easy to design such face masks with these teachings.

Importantly, some parts of these units will be made exchangeable in order to allow a different or new one to be used. The pieces that seal the area may be changed.

These unit will be made to be colorful likeable, and light-weight. The shields may be made from soft flexible materials. All of these will allow the manufacture of an adjustable unit that will be a very useful piece.

Importantly, the size, shape, thickness, consistency, relative size and thickness, coloring and every other important factor and characteristic of these units may vary in order to allow different units to be made for different purposes.

I claim:

1. A facial mask comprising a mask body having a frontal body portion for frontally fully covering a face;

said frontal body portion having a vertical expanse extending vertically from, and including, a forehead, to, and including a chin, and a lateral expanse extending laterally from, and including, a right cheek, to, and including, a left cheek;

said frontal body portion comprising a transparent zone for allowing a user to see through said body;

a vapor barrier disposed on a posterior surface of said frontal body portion as a continuous band that extends laterally from a location below and outward of a right eye, beneath a right eye, across a bridge of a nose, beneath a left eye, to a location below and outward of a left eye;

said vapor barrier comprising a thickness that, when the mask is worn, provides for the vapor barrier to contact the face along its lateral extent to prevent nasally and orally exhaled air from transpassing the barrier;

and means for securing the mask to a user.

2. A facial mask as set forth in claim 1 in which said vapor barrier separably attaches to said posterior surface of said frontal body portion.

3. A facial mask as set forth in claim 1 in which said vapor barrier comprises a resiliently compressible body.

4. A facial mask as set forth in claim 3 in which said resiliently compressible body comprises balloon means.

5. A facial mask as set forth in claim 3 in which said resiliently compressible body comprises a spongy material.

6. A facial mask as set forth in claim 1 in which said mask body comprises an opaque zone below said transparent zone.

7. A facial mask as set forth in claim 6 in which absorbent material is disposed on a posterior surface of said opaque zone for absorbing nasally and orally emitted material.

8. A facial mask as set forth in claim 1 in which absorbent material is disposed on the posterior surface of said frontal body portion in a location for absorbing nasally and orally emitted material.

9. A facial mask as set forth in claim 1 in which a breathing passage is disposed in said frontal body portion over the user's oral-nasal openings.

10. A facial mask as set forth in claim 9 in which said breathing passage comprises means providing for the effective area of the passage to be set by the user.

11. A facial mask as set forth in claim 10 in which said passage comprises an air-permeable filter through which air passes.

12. A facial mask as set forth in claim 11 in which said passage and filter are disposed in an assembly that separably mounts on said frontal body portion.

13. A facial mask as set forth in claim 1 in which said mask body further comprises further body portions that extend posteriorly from said frontal body portion over a frontal portion of a scalp, beneath a chin, and along sides of a face between chin and scalp.

14. A facial mask as set forth in claim 13 further including a cover member extending posteriorly from at least one of said further body portions for at least partially covering a head posterior to said further body portions.

15. A facial mask as set forth in claim 14 in which said cover member comprises a full covering for fully covering that portion of the head posterior to said further body portions.

16. A facial mask as set forth in claim 1 including a brim separably mounted on at least some of said further body portions.

17. A facial mask as set forth in claim 1 in which said frontal body portion comprises a multiple lamina construction in which one lamina is a layer that is bonded to another lamina for preventing separation of pieces of such another lamina in the event of shattering.

18. A facial mask as set forth in claim 1 in which said front body portion comprises a formable construction for conforming to a user's face.

19. A facial mask as set forth in claim 1 in which said vapor barrier has an anterior edge that passes across the bridge of the nose posteriorly of the anterior of the nose.

20. A facial mask comprising a mask body having a front body portion for frontally fully covering a face;

said frontal body portion having a vertical expanse extending from, and including, a forehead, to, and including a chin, and a lateral expanse extending laterally from, and including, a right cheek, to, and including, a left cheek;

said frontal body portion comprising a transparent zone for allowing a user to see through said body;

said mask body further comprising further body portions that extend posteriorly from said frontal body portion over a frontal portion of a scalp and along sides of a face below the scalp;

further including a brim member separably mounted on at least one of said further body portions, said brim member comprising an anteriorly projecting brim; and means for securing the mask to a user; and in which said further body portions of said mask body have a posterior edge which lies forwardly of the ears.

21. A facial mask as set forth in claim 20 in which said further body portions that extend over frontal portion of the scalp and along sides of the face below the scalp are overlapped by portions of said brim member posterior to said projecting brim.

* * * * *